US006761204B1

(12) United States Patent
Chou

(10) Patent No.: US 6,761,204 B1
(45) Date of Patent: Jul. 13, 2004

(54) WINDING WHEEL

(75) Inventor: Jser-Wen Chou, Placentia, CA (US)

(73) Assignee: Genes Industry Inc., Placentia, CA (US)

( * ) Notice: Subject to any disclaimer, the term of this patent is extended or adjusted under 35 U.S.C. 154(b) by 26 days.

(21) Appl. No.: 10/144,847

(22) Filed: May 15, 2002

(51) Int. Cl.[7] ..... E06B 9/322

(52) U.S. Cl. ..... 160/177 R; 242/388; 74/425; 74/606 R

(58) Field of Search ..... 160/177 R, 176.1 R, 160/178.1 R, 177 V, 176.1 V, 178.1 V, 168.1 R, 168.1 V, 170, 171, 173 R, 173 V; 242/388; 74/606 R, 425

(56) References Cited

U.S. PATENT DOCUMENTS 3,357,270 A * 12/1967 Spangenberg ..... 74/89.22
4,484,612 A * 11/1984 Vecchiarelli ..... 160/177 R
5,636,677 A * 6/1997 Liu ..... 160/177 R
5,680,892 A * 10/1997 Liu ..... 160/177 R
6,386,059 B1 * 5/2002 Mittendorf, Jr. ..... 74/409
6,561,254 B1 * 5/2003 Liu ..... 160/177 R

* cited by examiner

*Primary Examiner*—Blair M. Johnson
(74) *Attorney, Agent, or Firm*—Birch, Stewart, Kolasch & Birch, LLP

(57) ABSTRACT

An improved winding wheel includes an anchor dock housing a pulley and a movable base located on a lower side of the anchor dock having two biased holes. The pulley has a slant slot matching the biased holes to allow two ends of a cord to pass through in a separated manner towards two sides so that the cord may be wound on the pulley neatly without entangling. A movable anchor lug is provided on an upper side of the anchor dock. The movable anchor lug and the movable base may be lifted and extended to form an upper and a lower open space for the pulley such that the cord may be wound rapidly without obstruction.

3 Claims, 8 Drawing Sheets

WINDING WHEEL

FIELD OF THE INVENTION

The present invention relates to an improved winding wheel and particularly to a winding wheel adopted for use on window coverings such as curtains, draperies, shades and the likes.

BACKGROUND OF THE INVENTION

Window coverings such as curtains, draperies, shades and the likes usually are equipped with a winding wheel for controlling a cord to open or close the window coverings. The winding wheel generally is installed on a front end, a rear end or a middle section of the curtain track, and is constructed in many different ways. FIGS. 1 and 2 show a conventional winding wheel for mounting to a front end or a rear end of a curtain track. The winding wheel has a closed bottom end. As it does not have openings to allow a cord to pass through, a mounting seat must be installed on the track to hold the winding wheel. The mounting seat has a bottom section with openings formed thereon to allow cords to pass through. The side plate of the winding wheel also has a notch for the cord to anchor and pass through. Such a design and construction is untidy and takes a lot of efforts and more costs to install.

Moreover, the axle of conventional winding wheel set forth above usually is a fixed rivet. It is prone to break loose after using for a period of time. In addition, the winding wheel has two fixed support elements on two sides. When to install the winding wheel on the track, it should be coupled with the track from one end and moved sidewards slowly. Installation is time-consuming and troublesome.

Furthermore, as conventional winding wheels have a closed structure, curtains and draperies have to be mounted on two extreme sides. Installation range and flexibility is restricted.

All this indicates that conventional winding wheels still have problems in operation and installation. There are rooms for improvement.

SUMMARY OF THE INVENTION

The primary object of the invention is to provide a winding wheel that has a pulley with a slant slot formed thereon to thread a cord towards two sides and a movable base located on a lower side with two holes formed thereon in a biased angle to keep the cord in a confined location thereby enables the cord be moved and anchored without entangling.

Another object of the invention is to provide a winding wheel that has a pulley which has one side extending to form a worm with double teeth for controlling positioning of the curtain when it is moved downwards.

A further object of the invention is to provide a movable anchor lug on an upper side of the winding wheel and a movable lid on a lower side of the winding wheel that may be lifted and extended to form an angle directing outwards to give the winding wheel open upper and lower spaces to wind the cord without obstruction.

Yet another object of the invention is to provide a movable anchor lug which is anchored on two ends to couple with a movable base which is latched securely on a lower side such that a three-point anchoring is formed to enhance fastening of the winding wheel.

Still another object of the invention is to form an opening on the anchor dock of the winding wheel for threading the cord such that installation locations and scope of the winding wheel may be chosen easily without restrictions to match other control accessories of the curtain, and also to facilitate fast installation.

Yet another object of the invention is to provide a movable base and a hidden axle to obtain tidy appearance and secured installation without breaking off.

Moreover, the axle hole of the invention has a pointing ridge to match the axle so that the axle and the worm may be aligned accurately to keep the pulley on a horizontal level, and to allow the cord be pulled evenly with less efforts.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
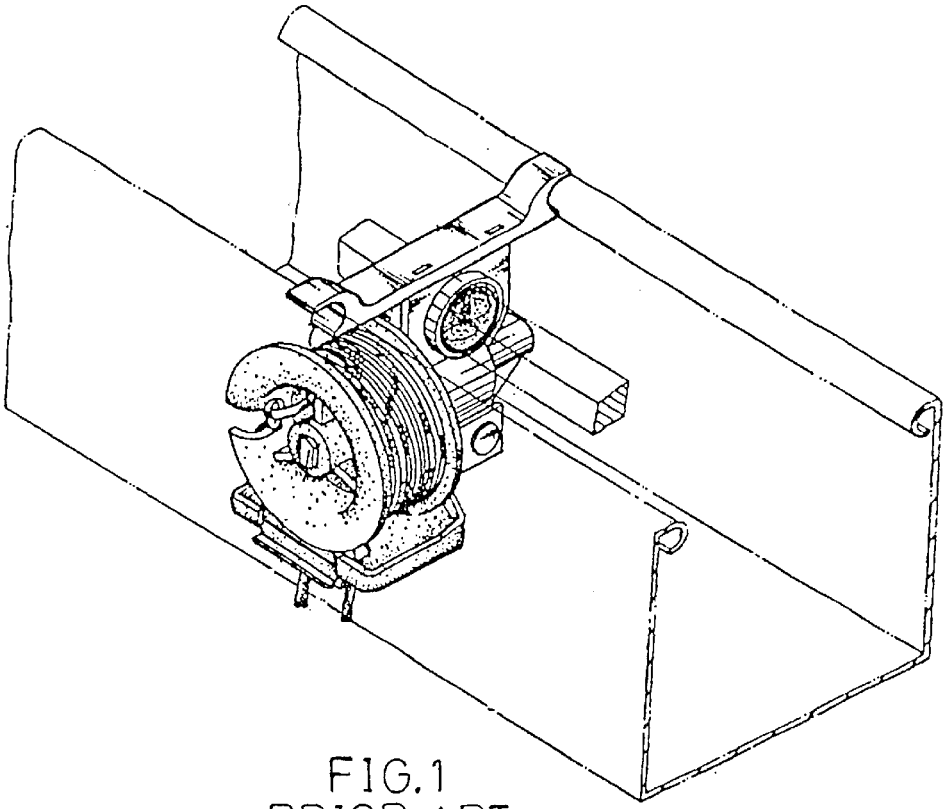
FIG. 1 PRIOR ART
FIG. 1 is a perspective view of a conventional winding wheel.
Figure 2:
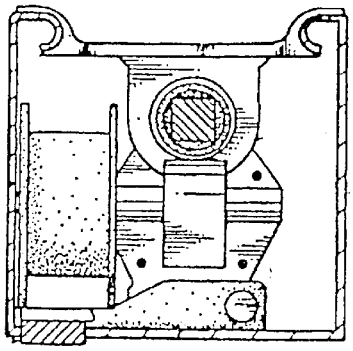
FIG. 2 PRIOR ART
FIG. 2 is a schematic view of a conventional winding wheel.
Figure 3:
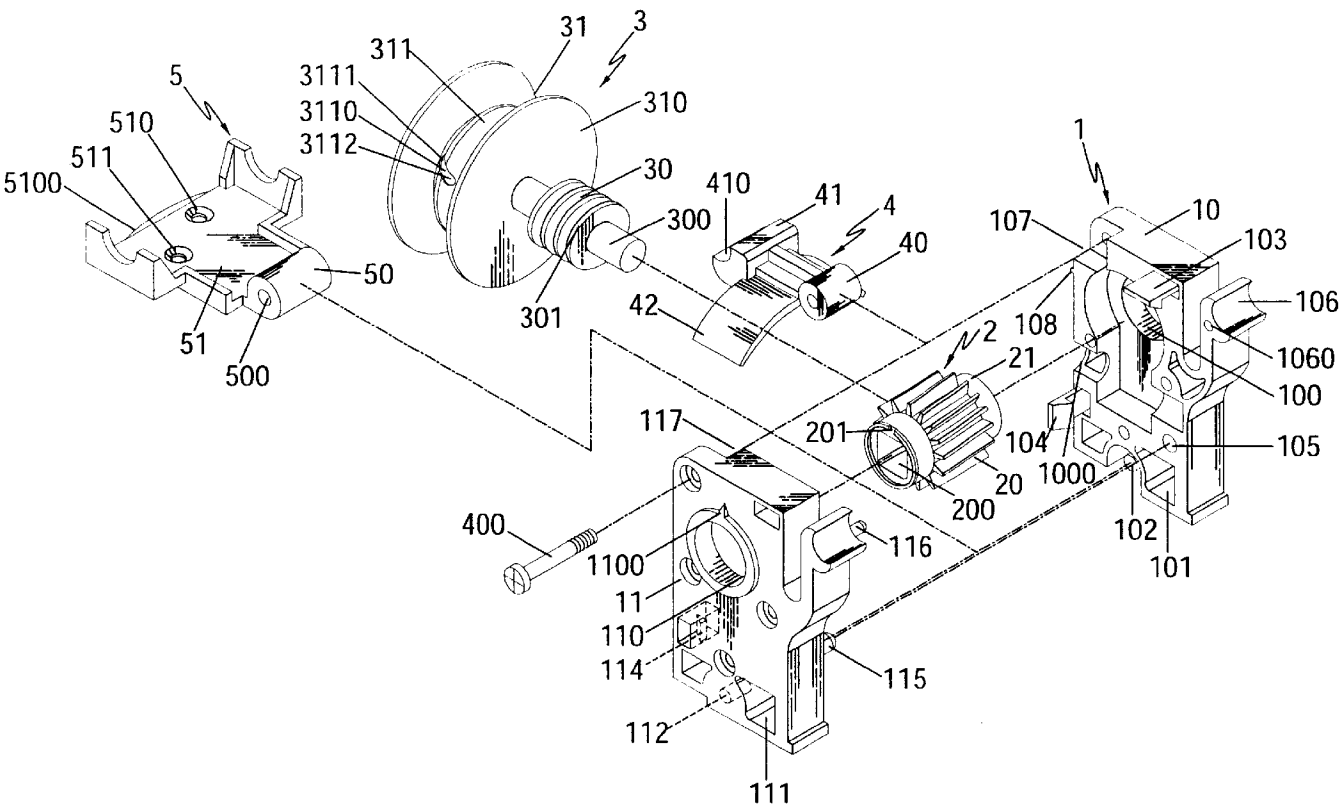
FIG. 3 is an exploded view of the invention.
Figure 4:
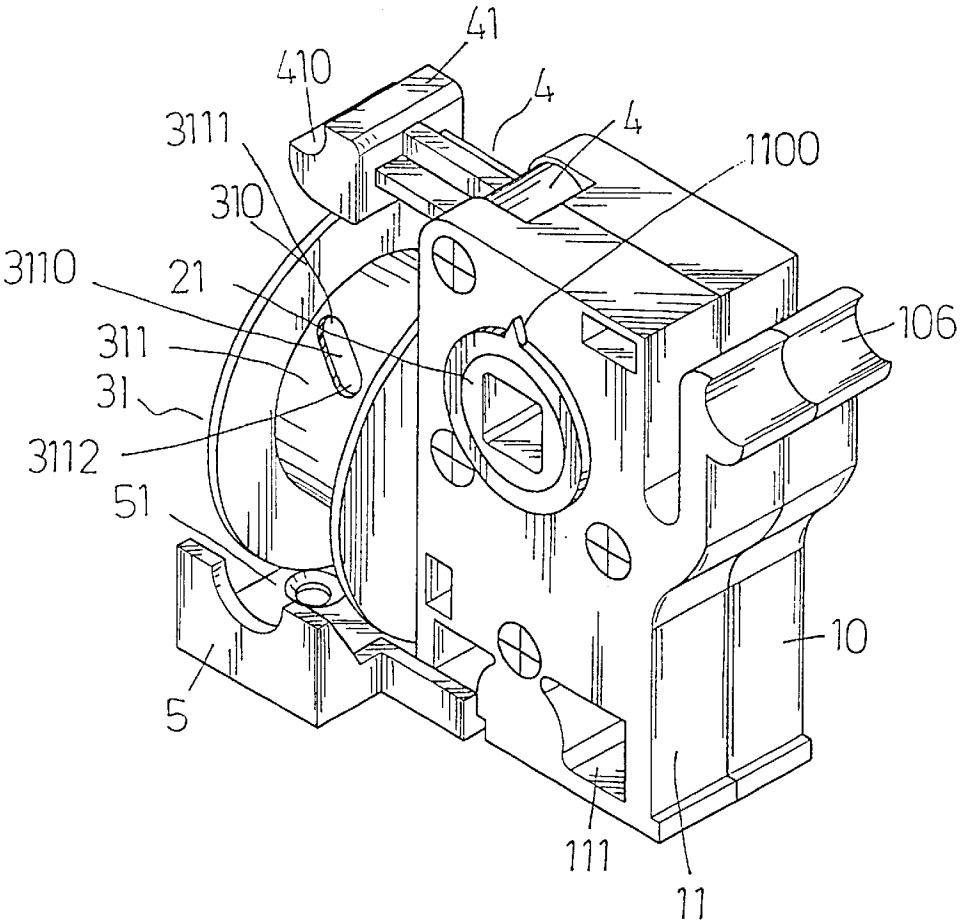
FIG. 4 is a perspective view of the invention.
Figure 5:
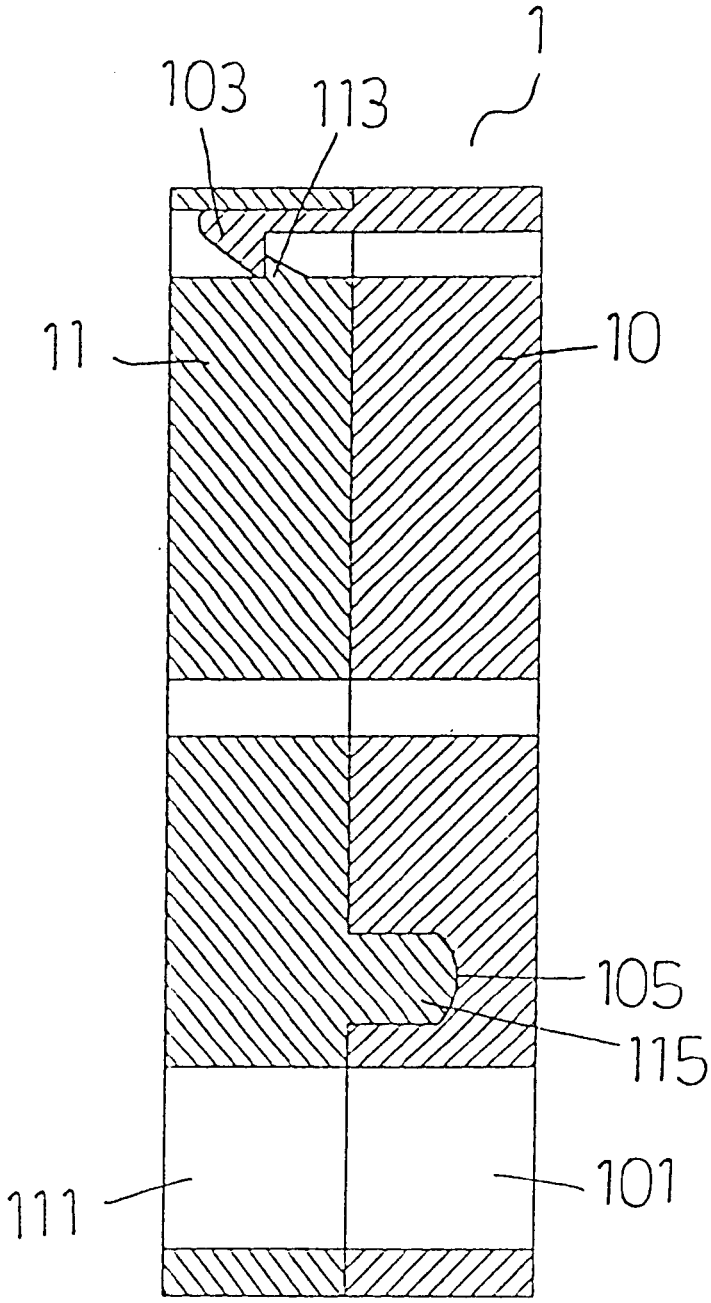
FIG. 5 is a cross section of two side boards coupling together.
Figure 7:
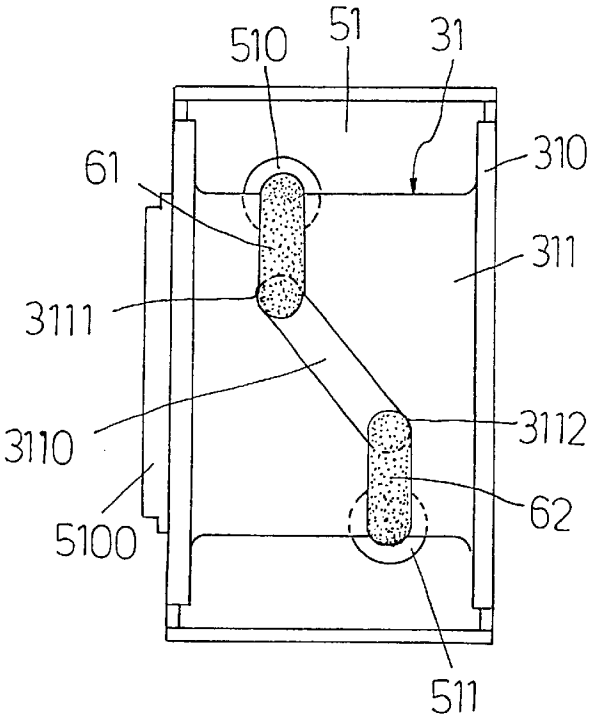
FIG. 7 is a schematic top view of the cord running through the movable base.

Referring to FIGS. 3 and 4, the winding wheel of the invention includes an anchor dock 1, an axle 2, a pulley 3, a movable anchor lug 4 and a movable base 5. The anchor dock 1 has first side board 10 and a second side board 11 coupling with each other, two housing openings 100 and 110 located in the center of an upper section thereof to couple with two struts 21 of the axle 2, an arched notch 1000 formed respectively on two sides to couple together for housing a stem 300 extending from two sides of a worm 30 located on one side of the pulley 3, and apertures 101 and 111 located on a bottom section, and two stub shafts 102 and 112 for coupling with the movable base 5. The first side board 10 has latching lugs 103 and 104 located respectively on the upper right and lower left portions to couple with matching latch holes 1130 and 1140 formed on the second side board 11. The first side board 10 further has a round opening 105 and an anchor arm 106 formed on the right side. The anchor arm 106 has a round cavity 1060. The second side board 11 has jutting stubs 113 and 114 formed respectively in the latch holes 1130 and 1140 to engage with the latching lugs 103 and 104, and wedge rods 115 and 116 engageable with the opening 105 and the cavity 1060 (as shown in FIG. 5). Furthermore, the side boards 10 and 11 have respectively a concave section 107 and 117 formed on the upper left corner to couple with a tubular element 40 of the movable anchor lug 4 through a screw 41 so that the movable anchor lug 4 is turnable. Beyond the concave sections 107 and 117, there are respectively a brake piece 108 and 118 to oppress against a side plate 310 of a wheel 31 of the pulley 3.

The axle 2 has a middle peripheral surface forming a worm gear 20 and a center hole 200 to allow the axle 2 to pass through. There is a pointing notch 201 formed on the peripheral surface of the axle 2. The worm 30 extending from one side of the pulley 3 is adopted a design of double teeth 301 for engaging with the worm gear 20. The axle 2 has two struts 21 extending from two sides to be housed in the housing openings 100 and 110.

Figure 6:
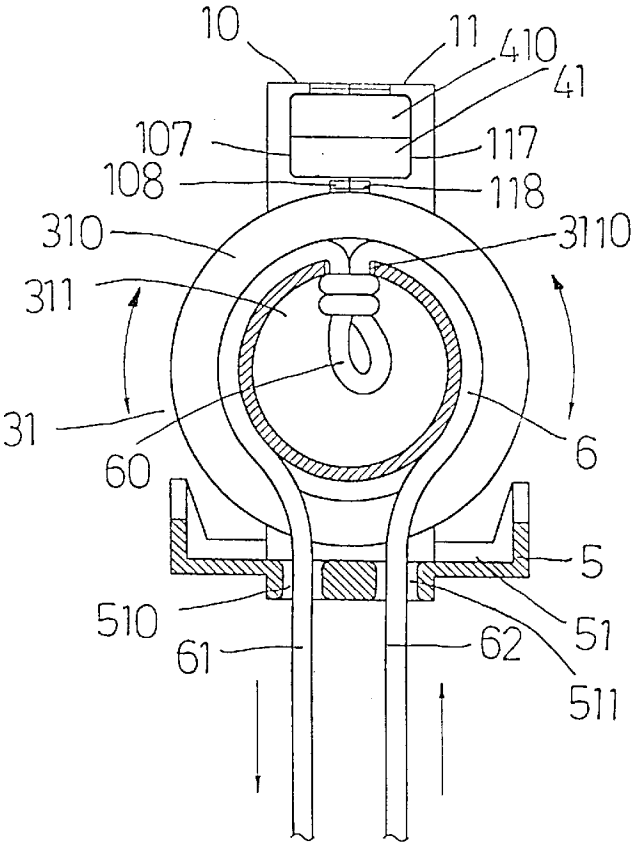
FIG. 6 is a schematic rear view of the pulley fastening to a cord and the cord threading through the movable base.

The pulley 3 has the worm 30 extending from one side thereof. The worm 30 has teeth 301 to engage with the worm gear 20 formed on the periphery of the axle 2. The worm 30 has a stem 300 extending from two sides thereof to couple with the arched notches 1000 on two sides of the side boards 10 and 11 in a turnable fashion. The pulley 3 has another end forming a wheel 31 for winding a cord 6. The wheel 3 has two side plates 310 one of which presses a lower end of the brake pieces 108 and 118 located on the left side of the side boards 10 and 11. The wheel 31 has a drum 311 in the center which has a slant slot 3110 formed thereon to allow a middle section 60 of the cord 6 to pass through and form a knob for anchoring in the inner diameter of the drum 311. Then two ends 61 and 62 of the cord 6 may pass through two holes 510 and 511 formed in a biased manner on the movable base 5 (as shown in FIG. 6). Thereby the positive and reverse ends 61 and 62 of the cord 6 may be separated and extending towards two sides to wind around the drum neatly and smoothly without entangling.

The movable anchor lug 4 has one end fastening to a tubular element 40 to receive and engage with a bolt 400 so that the tubular element 40 becomes turnable. The left hand side of the tubular element 40 is extended to form a support block 41 which has a holding trough 410 with an upward opening for anchoring to the track rim 70 of a curtain track 7.

The movable base 5 has a one side attaching to a barrel 50 which has a center hole 500 to couple with the stub shafts 102 and 112 of the side boards 10 and 11 so that the movable base 5 becomes turnable. The movable base 5 has another side extending to form a base plate 51 which has a moving flange 5100 formed in a biased manner to allow the positive and reverse ends 61 and 62 of the cord 6 to thread through separately.

Figure 8:
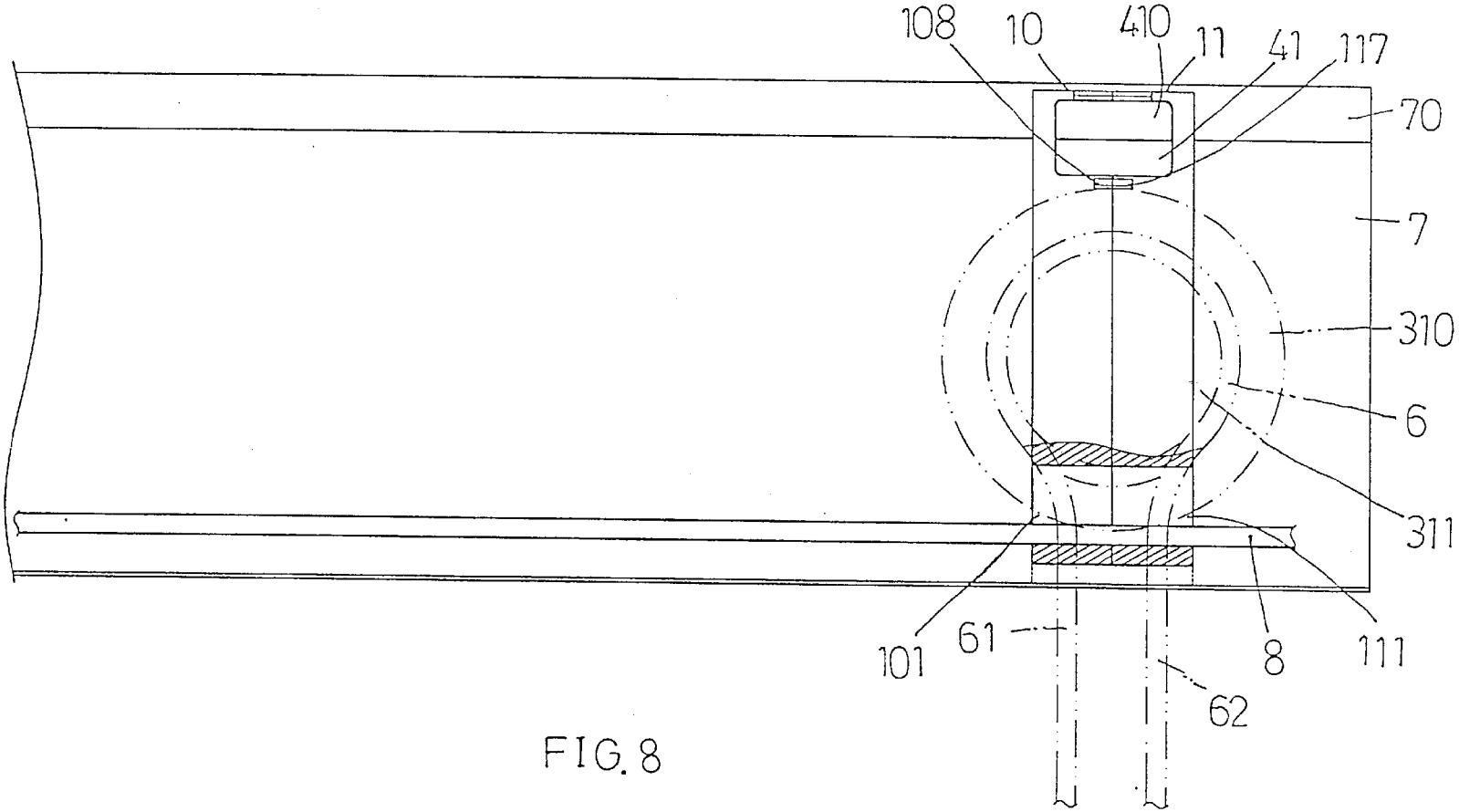
FIG. 8 is a schematic front view of the invention after installation.
Figure 9:
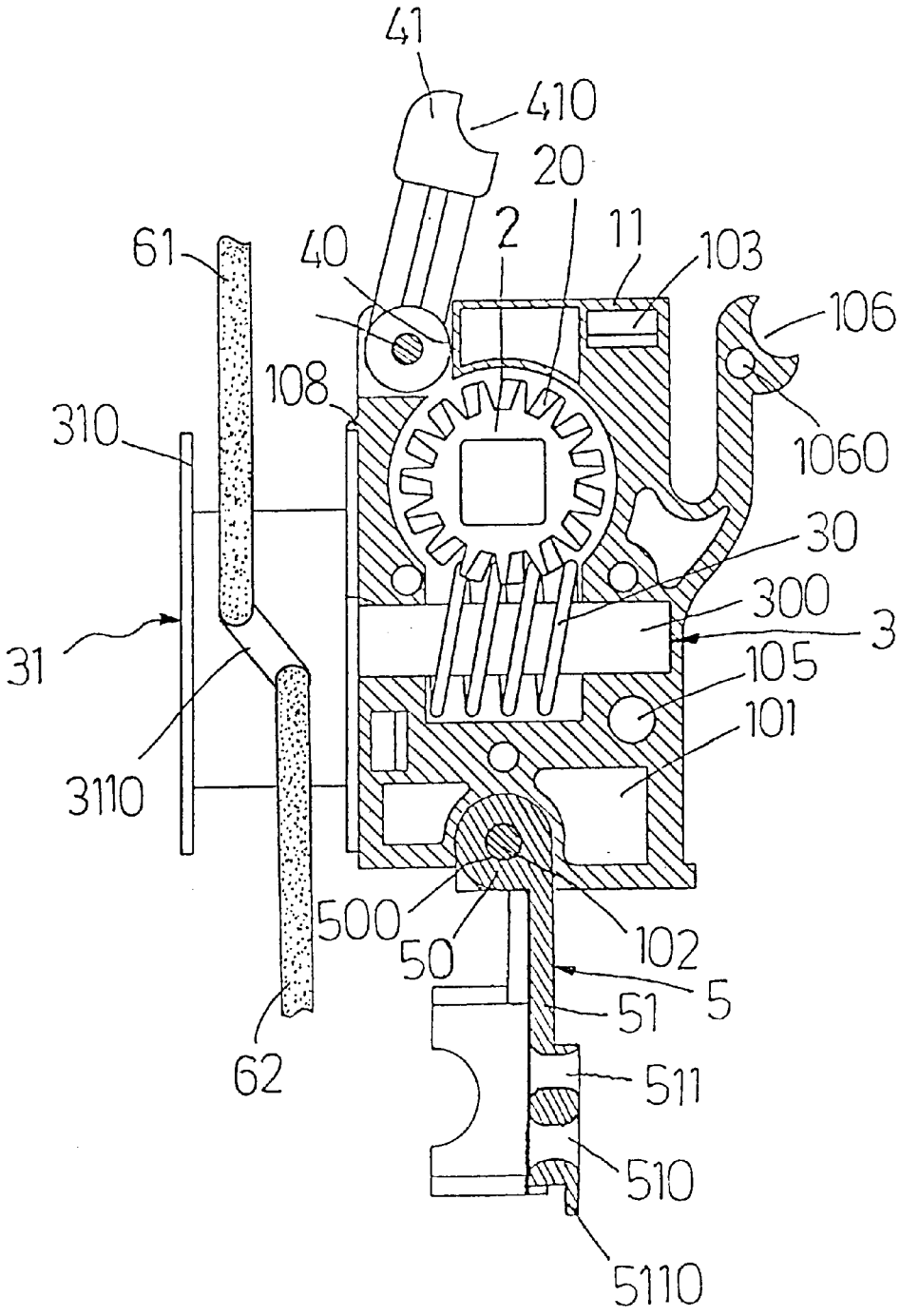
FIG. 9 is a schematic view of the anchor dock mounting to a track.
Figure 10:
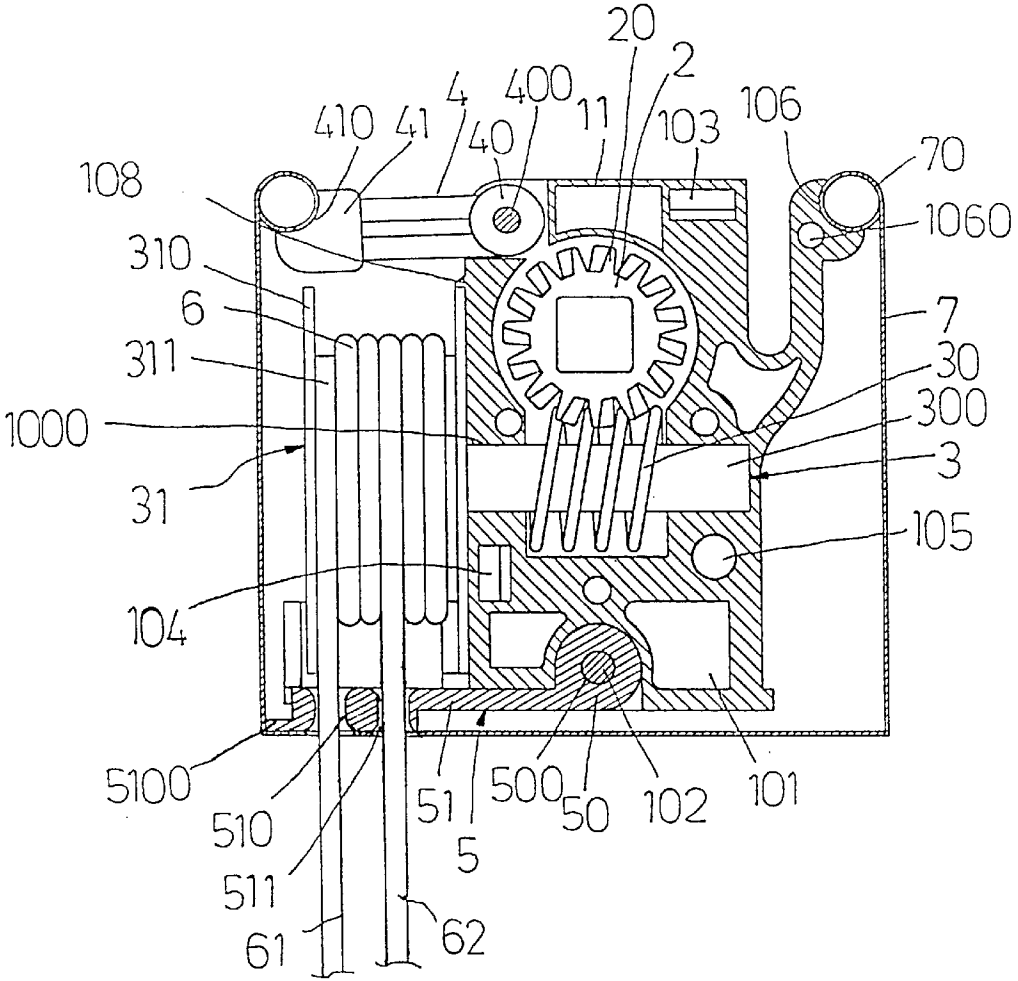
FIG. 10 is a schematic view of the anchor dock supported on three points.

When in use, the outside surface of the housing openings 100 and 110 of the side boards 10 and 11 have a pointing ridge 1100, and the apertures 101 and 111 located on the bottom section on the left and the right sides allow a rope 8 to pass through (as shown in FIG. 8). The movable base 5 is located in the middle section between the apertures 101 and 111. Thus the movable anchor lug 4 on the upper side and the movable base 5 on the lower side may be lifted and extended to give the pulley 3 an open space at the upper and lower side so that the cord 6 may be wound or extended without obstruction. Once the cord 6 is wound, the base plate 51 of the movable base holds the pulley 3 which has the cord wound thereon. The arched support block 41 on one end of the movable anchor lug 4, coupling with anchor arm 106 on the right hand side of the anchor dock 1, and the movable base 5 at the bottom end may directly hold the anchor dock 1 on a desired location, and securely hold the anchor dock 1 in a tubular member 70 on the top end of the curtain track 7 to form a three-point support for the anchor dock 1 (as shown in FIGS. 9 and 10).

What is claimed is:

1. An improved winding wheel, comprising:

an anchor dock including a first side board and a second side board corresponding to each other, the first side board having latching lugs coupling with matching latch holes formed on the second side board, and the first side board and the second side board having respectively a housing opening;

an axle housed in the housing opening having a worm gear formed thereon; and a pulley having a worm integrally formed and extended therefrom with teeth to engage with the worm gear, and a slant slot on a drum of said pulley to allow two ends of a cord to pass through and separate to thread through two holes formed on a movable base, the first side board and the second side board being pivotally engaged about respective horizontal axis with the movable base and a movable anchor lug, the movable anchor lug and the movable base being lifted and extended to form an upper space and a lower open space respective with the pulley thereby to allow the cord to wind on the pulley without obstruction or entangling.

2. The improved winding wheel of claim 1, wherein the movable anchor lug has an upwardly opening holding trough for anchoring on a track rim of a curtain track.

3. The improved winding wheel of claim 1, wherein the housing openings formed respectively on the first side board and the second side board are coupled to hold struts formed on the axle, the housing openings having an exterior surface with a pointing ridge formed on an upper location thereof, the axle having a pointing notch formed on an outer periphery alignable to the pointing ridge.

* * * * *

UNITED STATES PATENT AND TRADEMARK OFFICE

CERTIFICATE OF CORRECTION

PATENT NO. : 6,761,204 B1
DATED : July 13, 2004
INVENTOR(S) : Tser-Wen Chou

It is certified that error appears in the above-identified patent and that said Letters Patent is hereby corrected as shown below:

Title page,
Item [75], Inventor, change "Jser-Wen Chou" to -- Tser-Wen Chou --.

Signed and Sealed this

Twenty-sixth Day of October, 2004

JON W. DUDAS
*Director of the United States Patent and Trademark Office*